US006070300A

United States Patent [19]

Shin et al.

[11] Patent Number: 6,070,300

[45] Date of Patent: Jun. 6, 2000

[54] REFRIGERATOR DOOR SUPPORTING STRUCTURE

[75] Inventors: Youn-Tae Shin, Kwangju; Yong-Myoung Kim, Suwon, both of Rep. of Korea

[73] Assignee: Samsung Electronics Co., Ltd., Suwon, Rep. of Korea

[21] Appl. No.: 09/126,717

[22] Filed: Jul. 31, 1998

[30] Foreign Application Priority Data

Sep. 26, 1997 [KR] Rep. of Korea ..... P97-49254

[51] Int. Cl.[7] ..... E05D 7/12

[52] U.S. Cl. ..... 16/382; 16/DIG. 31

[58] Field of Search ..... 16/254, 257, 260, 16/265, 382, DIG. 31; 312/326, 405

[56] References Cited

U.S. PATENT DOCUMENTS

| | | | |
|---|---|---|---|
| 2,603,822 | 7/1952 | Evans | 16/265 |
| 3,618,993 | 11/1971 | Platte | 16/382 |
| 3,675,271 | 7/1972 | Fellwock et al. | 16/365 |
| 3,869,753 | 3/1975 | Boback | 16/382 |
| 4,547,930 | 10/1985 | King et al. | 16/382 |
| 5,870,801 | 2/1999 | Kim | 16/382 |
| 5,884,366 | 3/1999 | Jeong | 16/382 |
| 5,960,518 | 3/1999 | Jeong | 16/382 |

*Primary Examiner*—Chuck Y. Mah
*Assistant Examiner*—Donald M. Gurley
*Attorney, Agent, or Firm*—Burns, Doane, Swecker & Mathis, L.L.P.

[57] ABSTRACT

A refrigerator door supporting structure having middle and lower hinges fixed at a case, the structure comprising a fixation bracket disposed at a top door; a position fixation unit for coupling one end of the hinge plate to the fixation bracket; and a compression unit for pressing and fixing the hinge plate and, at the same time, for releasing the hinge plate from the fixation bracket when the pressing force is removed, thereby improving job efficiency in assembly of the refrigerator door and improving conveniences in moving a large refrigerator through a narrow gate.

4 Claims, 4 Drawing Sheets

FIG. 1(A)
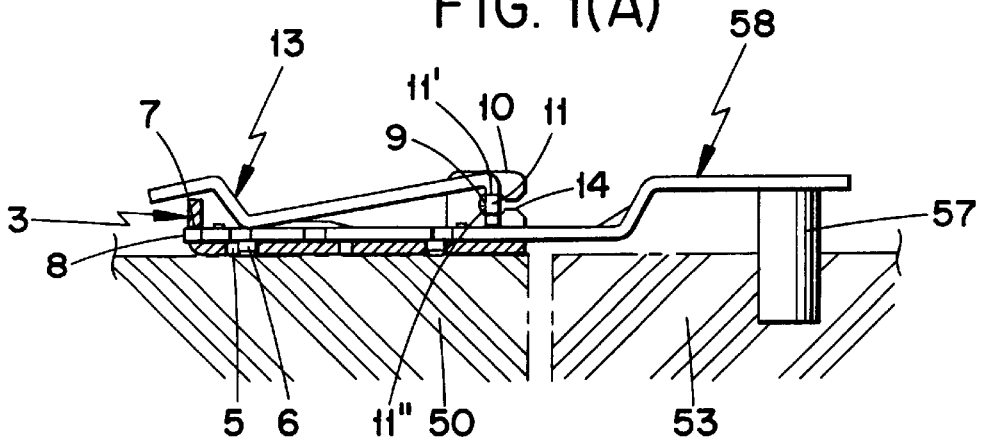
FIG. 1(B)
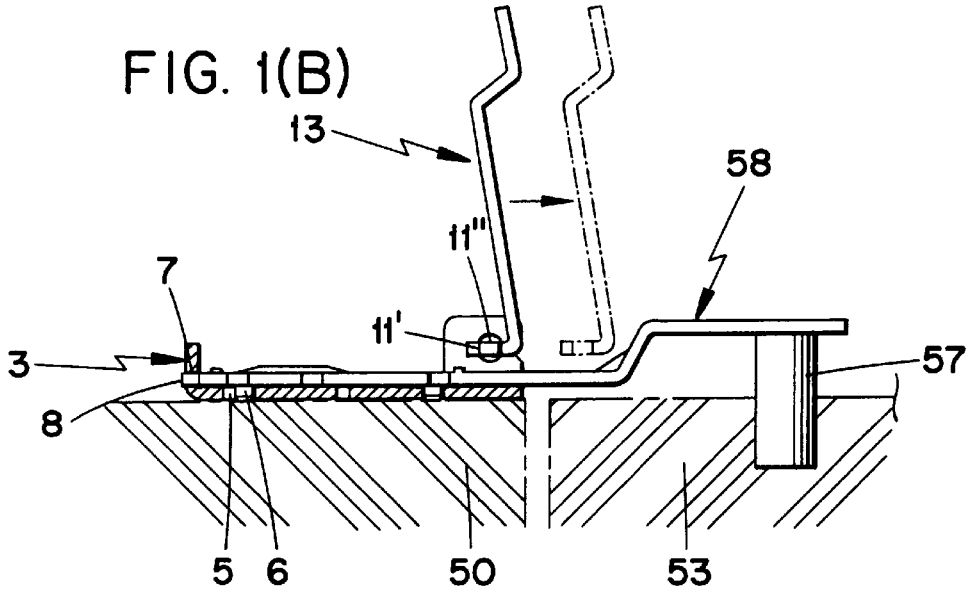
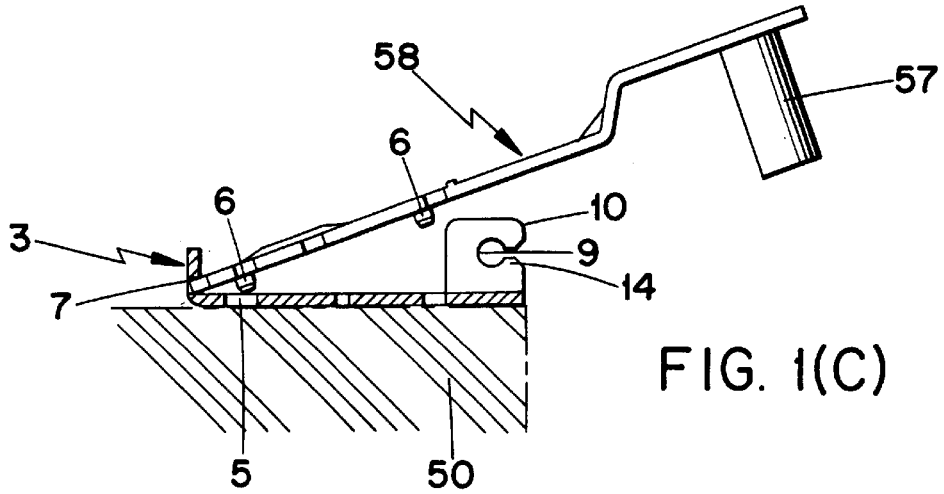
FIG. 1(C)

REFRIGERATOR DOOR SUPPORTING STRUCTURE

BACKGROUND OF THE INVENTION

1. Field of the Invention

The present invention relates to a refrigerator door supporting structure, and more particularly to a refrigerator door supporting structure rotatively installed to a refrigerator.

2. Description of the Prior Art

A conventional refrigerator is designed to store foodstuffs for a long period of time by using a freezing cycle of a refrigerant. The refrigerator includes a refrigerating chamber for storing foodstuffs in a non-frozen state for a short period of time and a freezing chamber for freezing and storing foodstuffs for a long period of time.

The refrigerator, as shown in FIG. 4, is provided with a case 50 divided into a refrigerating chamber and a freezing chamber refrigerating and freezing chamber doors 51, 52 rotatively installed for opening and closing respective chambers, and upper, middle and lower hinges 53, 54, 55 disposed at three different positions between the case and refrigerating and freezing chamber doors 51, 52, thereby forming an appearance of the refrigerator.

In other words, the upper, middle and lower hinges 53, 54, 55 are installed for rotatively supporting the refrigerating and freezing chambers doors 51, 52.

The upper hinges 53, as shown in FIG. 5, includes a case 50, a hinge plate 58 fixed with a bolt at one upper end of the case 50 and formed with a rotation protruder 57 at the other upper end, and an insertion member 59 fixed at an upper surface of the freezing chamber door 52 for getting the rotation protruder 57 inserted for smooth rotation.

Upper surface of the refrigerating chamber door 51 is supported at the middle hinge 54 while the refrigerating chamber door 51 is securely placed at the lower hinge 55. After the upper surface of the refrigerating chamber door 51 is supported at the middle hinge 54, the freezing chamber door 52 is securely positioned at the middle hinge 54. Then, the rotation protruder 57 at one end of the hinge plate 58 is inserted into the insertion member 59 of the freezing chamber door 52 and the other end of the hinge plate 58 is bolted at the upper surface of the case 50 for fixation.

The upper, middle and lower hinges 53, 54, 55 should be fixed on the case 50 firmly enough to support the weight of the doors of the refrigerator which is recently being made bigger and bigger.

Since refrigerators tend to be produced in a bigger size these days and the case thereof is tightly attached to the chamber doors, there arises a problem in the course of disassembling and reassembling an upper hinge at the uppermost area of the door when a big-sized refrigerator is moved through a relatively small gate of a house or an apartment owned by a user.

In other words, when an upper hinge is firmly assembled to the case of the refrigerator, a worker should perform the disassembling and reassembling tasks of the upper hinge on a big chair and the like for safe movement of the refrigerator through the gate, which causes much inconvenience and complication. There is an additional problem of the conventional refrigerator supporting structure in that job efficiency is decreased in assembling and disassembling the doors of the refrigerator.

SUMMARY OF THE INVENTION

The present invention is presented to solve the aforementioned problems and it is an object of the present invention to provide a refrigerator door supporting structure which improves a job efficiency in assembling and disassembling refrigerating and freezing chamber doors of a large refrigerator when it is moved through a relatively smaller gate.

In order to achieve the object of the present invention, there is provided a refrigerator door supporting structure having middle and lower hinges fixed at a case mounted for supporting refrigerating and freezing chamber doors, the structure comprising:

a fixation bracket disposed at a case upper door;

position fixation means for intermittently coupling one end of a hinge plate to the fixation bracket and for fixing a position thereof; and compression means for pressing and intermittently fixing the hinge plate and, at the same time, for releasing the hinge plate from the fixation bracket when pressing force is removed.

BRIEF DESCRIPTION OF THE DRAWINGS

For fuller understanding of the nature and object of the invention, reference should be made to the following detailed description taken in conjunction with the accompanying drawings in which:

FIG. 1 illustrates assembled sectional views for illustrating a refrigerator door supporting structure in accordance with the present inventions, where, FIG. 1A is an assembled sectional view for illustrating a refrigerator door as it is fixed, FIG. 1B is an assembled sectional view for illustrating a refrigerator door on which a fixation member is disassembled, and FIG. 1C is an assembled sectional view for illustrating a refrigerator door on which a door hinge is disassembled;

DETAILED DESCRIPTION OF THE INVENTION

Figure 2:
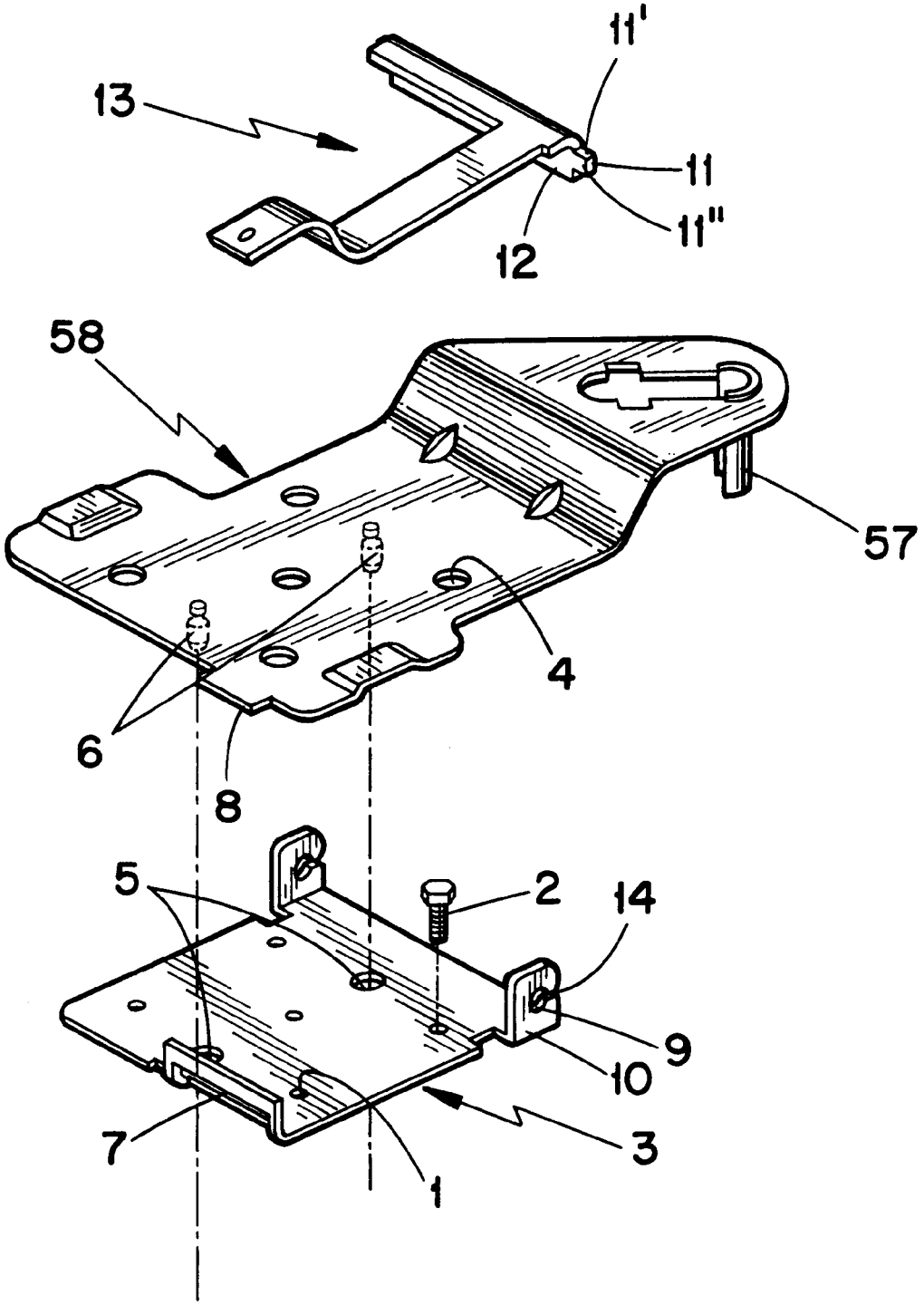
FIG. 2 is an exploded perspective view of FIG. 1.
Figure 3:
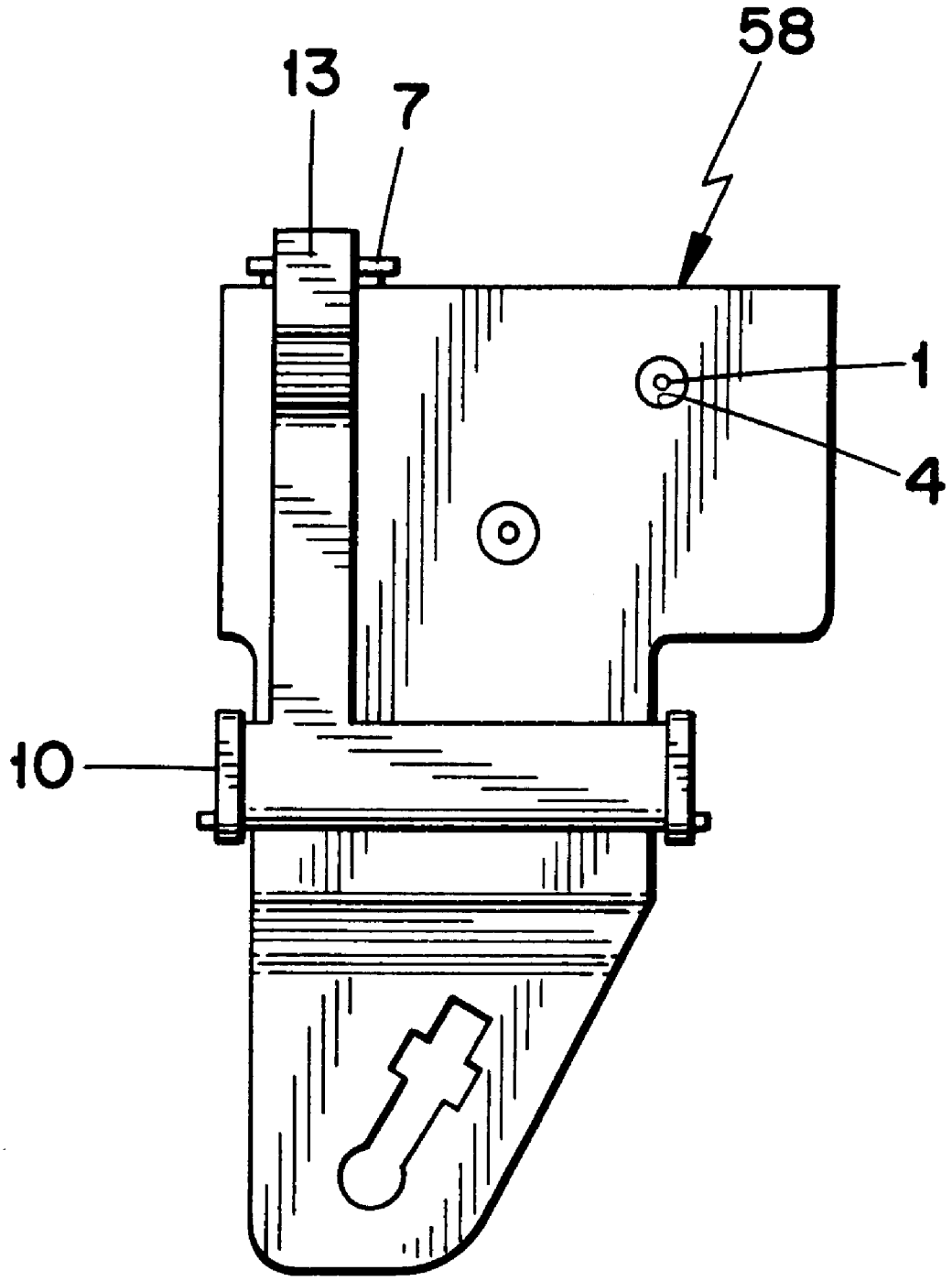
FIG. 3 is a plan of FIG. 1.
Figure 4:
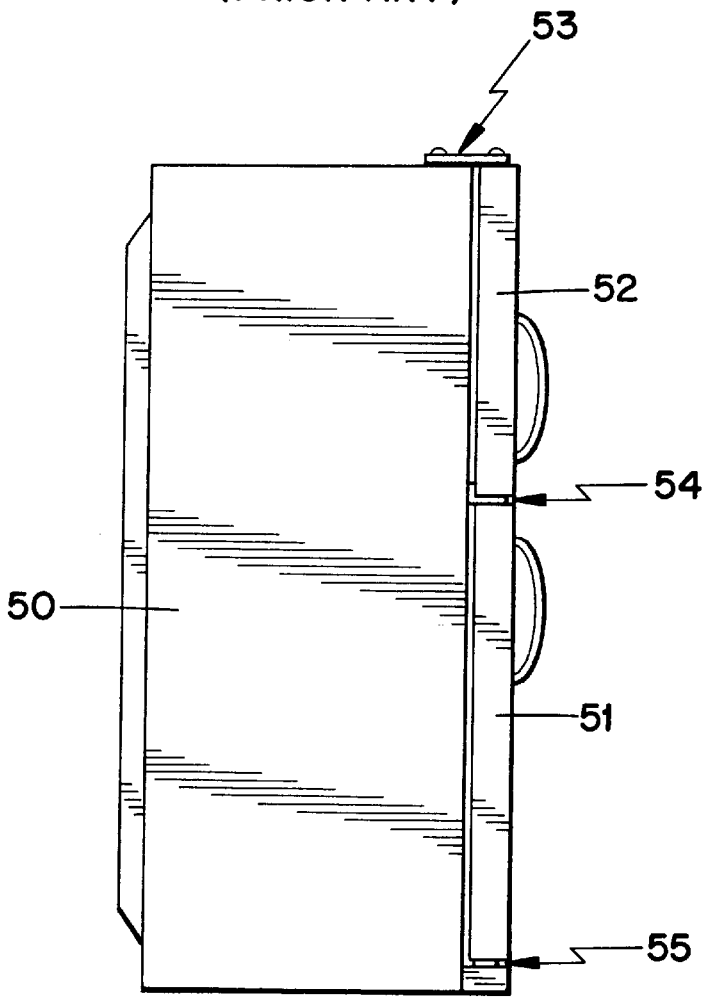
FIG. 4 (PRIOR ART)
FIG. 4 is a lateral view for illustrating an assembled state of a conventional refrigerator door.
Figure 5:
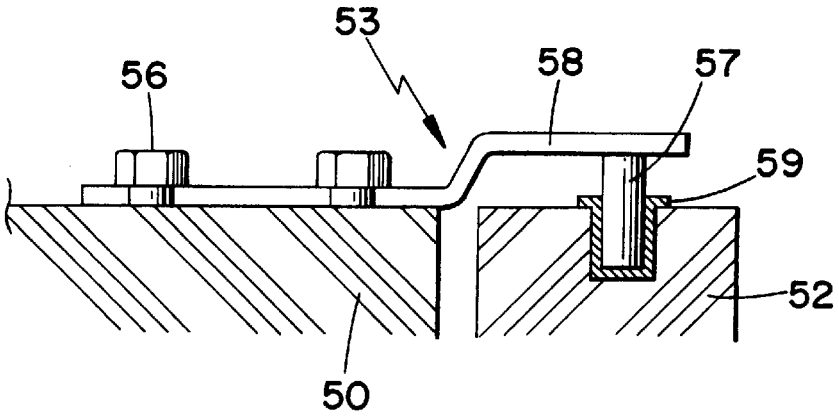
FIG. 5 (PRIOR ART)
FIG. 5 is a partially enlarged view for illustrating an assembly of an upper hinge on the upper surface of the refrigerator door in FIG. 4.

FIGS. 1, 2 and 3 are respectively a lateral sectional view, an exploded perspective view and a plan view of a refrigerator door supporting structure, where the structure comprises: a fixation bracket 3 disposed at a position, where an upper door of a case 50 is to be installed, along with a plurality of bolt holes 1 for getting the door attached to the case 50 with a plurality of bolts 2; position fixation means for coupling one end of a plate 58 to the fixation bracket and for fixing the position of the door; and compression means for pressing and fixing the hinge plate 58 and, at the same time, for releasing the hinge plate 58 from the fixation bracket 3 when the pressing force is removed.

In addition, a plurality of holes 4 are formed on the hinge plate 58 for refraining the bolt 2 which couples the fixation bracket 3 to the case 50 from being contacted with the hinge plate 58 when the bolt 2 is raised over the fixation bracket 3.

The position fixation means is provided with a plurality of fixation holes 5 formed on the upper surface of the fixation bracket 3, a plurality of fixation protruders 6 formed on the lower surface of the hinge plate 58 for preventing horizontal movement of the hinge plate 58 by being inserted into the fixation holes 5, an insertion hole 7 formed at one side of the fixation bracket 3 and an insertion protruder 8 formed at the hinge plate 58 for preventing its vertical movement by being inserted to the insertion part 7.

The fixation holes 5 and fixation protruders 6 block the horizontal movement of the hinge plate 58 while the insertion hole 7 and the insertion protruder 8 block the vertical movement of the hinge plate 58. Therefore, the hinge plate 58 is firmly fixed at the fixation bracket 3.

The pressing means includes two rotation supporters 10 extended at one end of the fixation bracket 3, while facing each other, a lever 13 having rotational protruders 11 formed at both ends thereof for being inserted into holes 9 of the rotation supporters 10 and for being rotated and pressing part 12 formed for pressing and fixing the hinge plate 58 in assembly, and separation means formed for conveniently taking the lever 13 off from the fixation bracket 3.

The separation means includes a narrow groove 14 of a predetermined width at one end of the larger rotational hole 9 and a square rotational protruder 11 disposed for being released out of the groove 14 when the rotational protruder 11 is not pressed by the hinge plate 58 and for being stuck in the groove 14 when the rotational protruder 11 is tightly pressed by the hinge plate 58.

Therefore, when the lever 13 is rotated to press the hinge plate 58, the wide dimensional portion 11' of the rotational protruder 11 is hitched at the groove 14 to refrain the lever 13 from sliding out of the fixation bracket 3. On the other hand, when the lever 13 is rotated not to press the hinge plate 58, the narrow dimensional portion 11" of the rotational protruder 11 is released out of the groove 14.

When a worker assembles a door onto a refrigerator, he fixes the door onto lower and middle hinges 54, 55. Then, the fixation bracket 3 is positioned at one end of the upper surface of the case 50 and fixed at the bolt hole 1 with the bolt 2.

When the fixation bracket 3 is fixed with the bolt 2, the fixation protruder 6 and insertion protruder 8 of the hinge plate 58 are inserted into the fixation hole 5 and insertion hole 7 of the fixation bracket 3. If the insertion protruder 8 and fixation protruder 6 are respectively inserted into the fixation hole 5 and insertion hole 7, the position of the hinge plate 58 is fixed to thereby refrain from any horizontal and vertical movement of the hinge plate 58.

When the hinge plate 58 is inserted into the fixation bracket 3, the rotational protruder 11 of the lever 13 is accordingly inserted into the rotation supporter 10 of the fixation bracket 3.

If the narrow portion 11" of the square rotational protruder 11 is positioned at the groove 14 and pushed into the rotational hole 9 of the rotation supporter 10, the wide portion 11" of the rotational protruder 11 is closely attached to the groove 14 thereby preventing the lever 13 from sliding out of the rotation supporter 10.

When the lever 13 is rotated, the pressing part 12 formed at one lower end of the lever 13 presses the upper surface of the hinge plate 58 thereby preventing any movement of the hinge plate 58.

The rotational protruder 57 of the hinge plate 58 is kept in the insertion member 59 of the refrigerator door 52. When the refrigerator is moved into a customer's house with a narrow gate, the doors 51, 52 are easily separated from the case 50.

At this time, if the lever 13 is rotated clock-wise in the drawings, the lever 13 can be taken out as shown in FIGS. 1–2. When the lever 13 is taken out of the rotation supporter 10, the hinge plate 58 is released in practice. If the released hinge plate 58 is pulled upwards, the hinge plate 58 is taken out of the fixation hole 5 and insertion hole 7 of the fixation bracket 3.

When the hinge plate 58 is taken out of the fixation bracket 3, the door 52 can be taken off. Therefore, the door can be very conveniently taken off by rotating the lever 13 without even looking over the case 50. Therefore, the job efficiency is greatly improved.

Therefore, there is an advantage in the refrigerator door supporting structure in that the hinge plate is conveniently taken out by rotation of the lever thereby improving job efficiency in assembly of the refrigerator door and improving conveniences in moving a large refrigerator through a narrow gate.

What is claimed is:

1. A refrigerator comprising:

a case;

a refrigerator door mounted on the case;

a hinge arrangement for rotatably mounting the door to the case, the hinge arrangement including a plurality of vertically spaced hinge assemblies, including a top hinge assembly disposed at a top of the case, the top hinge assembly including:

a fixation bracket mounted on an upper surface of a top wall of the case, a hinge plate including a first end portion removably connected to the fixation bracket, and a second end portion removably connected to the door, a releasable compression device for pressing the first end of the hinge plate downwardly against the fixation plate to prevent removal of the hinge plate from the fixation plate, the compression device comprising:

a pair of rotation supporters mounted on the fixation bracket in mutually facing relationship, and a lever including protruders rotatably mounted in respective ones of the rotation supporters, to permit the lever to rotate relative to the hinge plate, and a pressing portion for engaging and pressing the second end of the hinge plate downwardly against the top of the fixing plate;

the protruders being removable from the rotation supporters to enable the lever to release the hinge plate for removal from the door and the hinge plate.

2. The refrigerator according to claim 1 wherein the fixation bracket includes vertical fixation holes formed therethrough, the first end portion of the hinge plate having downwardly extending fixation protruders mounted in the fixation holes, an end of the fixation bracket located opposite the rotation supporters having a horizontal insertion hole disposed therein, the first end portion of the hinge bracket including an insertion protruder extending into the insertion hole.

3. The refrigerator according to claim 1 wherein each of the rotation supporters includes a hole communicating with an edge of the rotation supporter by a narrow groove, each of the protruders including first and second dimensions, the first dimension being wider than the groove, and the second dimension being narrower than the groove, the protruders being rotatable within the holes and configured such that the first dimension of the protruders faces the groove when the pressing portion presses against the hinge plate, and the second dimension of the protruder faces the groove when the pressing portion is out of pressing engagement with the hinge plate, whereby the lever is non-removable from the fixation bracket while pressing against the hinge plate.

4. A refrigerator comprising:

a case;

a refrigerator door mounted on the case;

a hinge arrangement for rotatably mounting the door to the case, the hinge arrangement including a plurality of vertically spaced hinge assemblies, including a top hinge assembly disposed at a top of the case, the top hinge assembly including:

a fixation bracket mounted on the case, a hinge plate including a first end portion removably connected to the fixation bracket, and a second end portion removably connected to the door, a releasable compression device for pressing the first end of the hinge plate downwardly to prevent removal of the hinge plate from the fixation plate, the compression device comprising:

a pair of rotation supporters mounted on the fixation bracket in mutually facing relationship, and a lever including protruders rotatably mounted in respective ones of the rotation supporters, to permit the lever to rotate relative to the hinge plate, and a pressing portion for engaging and pressing the second end of the hinge plate downwardly, each of the rotation supporters including a hole communicating with an edge of the rotation supporter by a narrow groove, each of the protruders including first and second dimensions, the first dimension being wider than the groove, and the second dimension being narrower than the groove, the protruders being rotatable within the hole and configured such that the first dimension of the protruders faces the groove when the pressing portion presses against the hinge plate, and the second dimension of the protruder faces the groove when the pressing portion is out of pressing engagement with the hinge plate, whereby the lever is non-removable from the fixation bracket while pressing against the hinge plate.

* * * * *